United States Patent [19]

Stahlecker et al.

[11] Patent Number: 4,483,136

[45] Date of Patent: Nov. 20, 1984

[54] PNEUMATIC FIBER CONTROL ARRANGEMENT FOR OPEN END FRICTION SPINNING MACHINES

[75] Inventors: Fritz Stahlecker, Josef-Neidhart-strasse 18, 7347 Bad Überkingen; Heinz Merkel, Göppingen-St. Gotthardt, both of Fed. Rep. of Germany

[73] Assignees: Hans Stahlecker, Süssen; Fritz Stahlecker, Bad Überkingen, both of Fed. Rep. of Germany

[21] Appl. No.: 583,231

[22] Filed: Feb. 24, 1984

[30] Foreign Application Priority Data

Mar. 9, 1983 [DE] Fed. Rep. of Germany ..... 3308250

[51] Int. Cl.³ ..... D01H 1/135; D01H 7/898

[52] U.S. Cl. ..... 57/401

[58] Field of Search ..... 57/400, 401, 403

[56] References Cited

U.S. PATENT DOCUMENTS

| | | | |
|---|---|---|---|
| 4,060,966 | 12/1977 | Konig | 57/401 |
| 4,281,507 | 8/1981 | Didek et al. | 57/401 |
| 4,348,859 | 9/1982 | Olsson | 57/401 |
| 4,404,792 | 9/1983 | Parker et al. | 57/401 |

*Primary Examiner*—Donald Watkins

*Attorney, Agent, or Firm*—Barnes & Thornburg

[57] ABSTRACT

The disclosure relates to open end friction spinning devices of the type having fibers supplied in an air stream to a yarn forming slot between two friction rollers driven in the same rotational direction. Auxiliary air supply arrangements are described for supplying an air flow to counteract the tendency of fibers to adhere to the friction roller rotating outwardly from the yarn forming slot. These auxiliary air supply arrangements also aid in returning and properly aligning fibers in the yarn forming region of the yarn forming slot.

33 Claims, 11 Drawing Figures

PNEUMATIC FIBER CONTROL ARRANGEMENT FOR OPEN END FRICTION SPINNING MACHINES

BACKGROUND AND SUMMARY OF THE INVENTION

The invention relates to an open end friction apparatus of the type having two friction rollers driven in the same rotational direction and arranged adjacent one another to form a yarn spinning wedge slot. Fiber material in the form of single fibers is fed by means of a fiber feed channel to the wedge slot where it is twisted together in a yarn formation region of the wedge slot to form a yarn that is withdrawn by a withdrawal device. The mouth of the fiber feed channel, which is inclined to the withdrawal direction of the yarn, is disposed in the region of the yarn formation region of the wedge slot.

With a known apparatus or device of the above mentioned kind, described in published European patent application No. (EP-OS) 62 404, an opening or fiber inlet chamber connected at the fiber feed channel is disposed in the region of the wedge slot closesly adjacent to the yarn building region and extending approximately over the entire length of the wedge slot. A suction device is additionally connected to the opening chamber for applying a suction air flow effect against the yarn withdrawal direction. The lateral walls of the opening chamber are provided with concave surfaces which conform to the cover surfaces of the two rollers and which are disposed at a small distance from these cover surfaces so that the least possible air can penetrate in this region. The actual opening of the opening or inlet chamber is arranged at the wedge slot and exhibits a slight component toward the cover surface of the roller rotating inwardly toward the yarn formation region. The roller rotating in toward the yarn formation region is constructed as a so-called suction roller which exhibits a perforated cover surface and an inside suction insert, which suction insert is fitted with a slit opening at the yarn formation region. The roller rotating outwardly from the yarn formation region possesses a cylindrical closed cover surface.

In this kind of device, the fibers are twisted together to form a yarn on the basis of the connection through friction at the cover surfaces, which yarn is then withdrawn in the longitudinal direction of the wedge slot. There exists the danger that single or also several fibers are carried from the roller rotating outwardly from the yarn formation region and are lost as far as yarn spinning is concerned or also form a fiber collection reverting again to the yarn formation region which leads to non-uniformity in the yarn.

In another apparatus, described in German published unexamined application (DE-OS) No. 3213478, which is principally used for the manufacture of so-called wrapped yarn that consists of a previously finished yarn and fibers wrapped there around, there are likewise two adjacently arranged rollers driven in a similar rotational direction. The two rollers form a wedge slot in which single fibers are guided between two guide surfaces toward the direction of the wedge slot, which, if necessary, should be formed with facing walls into a channel. These guide surfaces end at a relatively large distance from the wedge slot. In order to provide that the fed fibers do not extend near to the cover surfaces of the two rollers, auxiliary air stream suction which should have an increased stream speed is provided laterally of the two guide surfaces. Such an arrangement does not seriously hinder the carrying of fibers with the roller rotating outwardly of the yarn formation region. It is therefore provided that the rollers are surrounded with a guide surface which should form a guide channel in which fibers that were eventually carried along with the roller are guided around this roller and again fed to the wedge slot.

The invention is based upon the problem to so construct an open end friction spinning arrangement of the above mentioned kind that it is assured with a high degree of certainty that fibers are not carried with the roller rotating outwardly from the yarn formation region.

This problem is thereby solved by the invention providing an air inlet opening between the mouth of the fiber feed channel and the yarn formation region at the side of the roller rotating outwardly from the yarn formation region and using the air inlet opening to create an air stream directed from the cover surface of this roller to the yarn formation region.

The air stream facilitated by the air inlet opening means provides that the fibers which eventually are carried with the roller rotating outwardly from the yarn formation region are loosened therefrom and remain in the yarn formation region, in which they are bound into the yarn. It is thereby possible to spin a very uniform yarn because a constant volume of fibers in the yarn formation region is guaranteed.

In an advantageous embodiment of the invention it is provided that the cover surface of the two rollers, at least at the side of the mouth of the fiber feed channel, are covered by means of a plate with shell shaped recesses conforming to the countour of the rollers. An inlet channel with a slit formed mouth is arranged in the plate adjacent the mouth of the fiber feed channel at the cover surface of the roller turning outwardly from the yarn formation region. The thereby facilitated air stream can be effected through a suction which also creates the transport air stream in the fiber feed channel. Through the selection of the cross section of the air inlet channel, which cross section can be formed to be adjustable, as necessary, the effect of the air stream can be controlled.

In further arrangements of the invention it is provided that the air inlet channel is connected at an air pressure source. In this arrangement the effect of the auxiliary air stream can be controlled by adjusting the pressure. With this arrangement it can advantageously be further provided that between the air inlet channel and the fiber feed channel there are arranged one or several connecting channels having components in the transport direction of the fibers. Thereby it is possible with the help of the air pressure source on the basis of an injector principle to create the transport air stream in the fiber feed channel or at least to support the same.

In another arrangement of the invention it is provided that the roller rotating outwardly from the yarn formation region exhibits a perforated cover surface and an air pressure insert fitted with a slit opening at the region between the mouth of the fiber feed channel and the yarn formation region. With this air pressure insert an air stream is created which assures the loosening of fibers that may be carried at the cover surface of the roller rotating outwardly from the yarn formation region and the loosened fibers are returned to the yarn formation region.

In further arrangements of the invention it is provided that the air inlet opening extends along a cover surface or line approximately over the entire length of the roller rotating outwardly from the yarn formation region. With this arrangement it is achieved that the yarn being formed is held securely in the wedge slot downstream of the mouth of the fiber feed channel so that the yarn achieves a uniform rotation/twisting. Irregularities in the yarn are also precluded in this manner. Through the air inlet opening, which offers the only possibility for air entry in this region of the wedge slot, an air stream with a certain alignment is achieved while only a relatively small air volume is necessary therefore.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
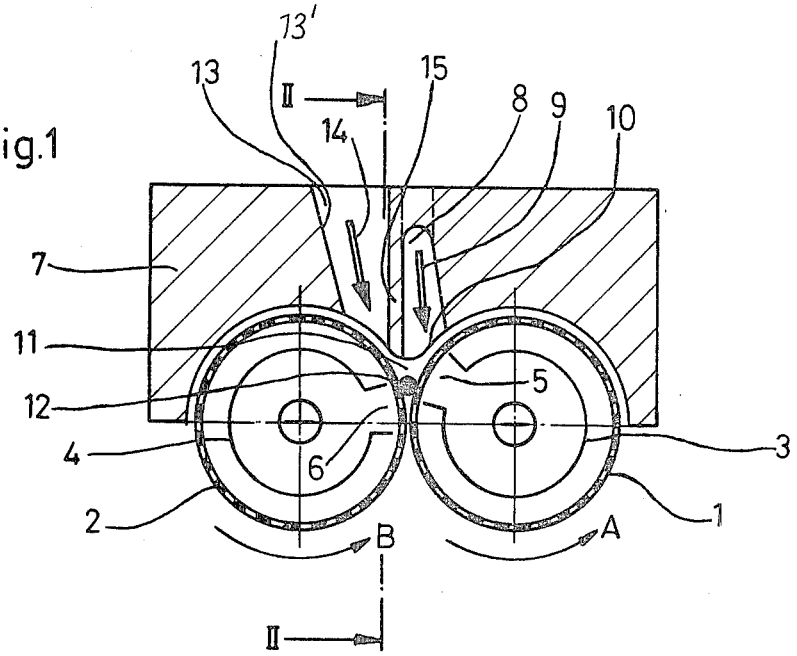
FIG. 1 is a schematic cross-sectional view, taken along line I—I of FIG. 2, through the region of the friction rollers and the fiber feed channel of an open end spinning arrangement constructed in accordance with a first preferred embodiment of the invention.

In order not to obscure the present invention, in the drawings and in the following description, only those portions of an open end friction spinning machine are illustrated and described which are deemed sufficient to enable one skilled in the art to make and use the same. Reference is hereby made to the following commonly assigned U.S. patent applications for further background disclosure of the types of spinning machines that the invention is related to:

U.S. patent application Ser. No. 558,281
Filed Dec. 5, 1983, and

U.S. patent application Ser. No. 573,633
Filed Jan. 25, 1984.

In the drawing figures, like reference characters are used for like structures throughout the various figures.

Figure 2:
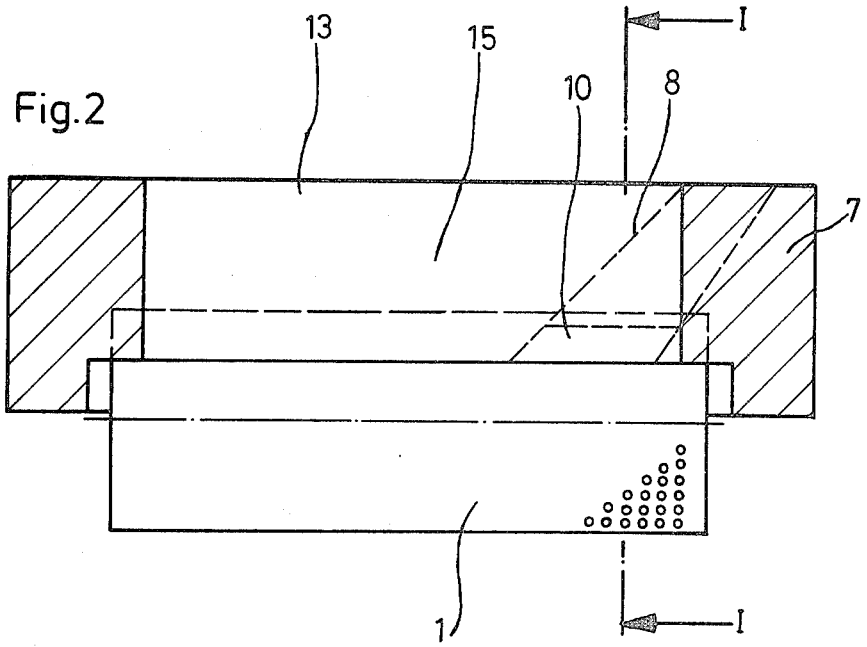
FIG. 2 is a schematic longitudinal sectional view taken along line II—II of FIG. 1.

The open end friction spinning unit illustrated only partly in FIGS. 1 and 2 possesses two parallely extending closely adjacent friction rollers 1 and 2, which form a yarn forming wedge slot 11 therebetween. Both rollers 1 and 2 are driven in a not further illustrated manner in the same sense in the direction of arrows A and B. The invention is preferably used with spinning machines including a plurality of such spinning units arranged side by side and driven by a common drive, such as a tangential belt engaging shafts of the friction rollers.

The wedge slot 11 is fed with single fibers of opened fiber material via a fiber feed channel 8 by means of a transport air stream 9. The fibers are twisted into a yarn in a yarn formation region 12 of the wedge slot 11 due to the effect of the there turning cover surfaces of the rollers 1 and 2. The yarn is drawn off in the longitudinal direction of the wedge slot 11 by means of a not further illustrated withdrawal device, which includes two rollers between which the yarn passes.

The cover surfaces of both rollers 1 and 2 are covered at the side of the fiber feed channel 8 with a support plate or block 7 which exhibits half cylindrical recesses that conform to the contour of the rollers 1 and 2 and which cover approximately half the circumference of both rollers 1 and 2. This plate 7 includes a part of the fiber feed channel 8, which channel 8 has a mouth 10 opening toward the rollers. The fiber feed channel 8 is directly, or by means of a not illustrated intermediate part, connected with a feeding and opening device at which a fiber band or beard is opened to individual fibers. Feeding and opening devices of this general kind are known in open end rotor spinning machines. The fiber feed channel 9 extends, in practical embodiments, in a straight line extension to the beginning channel piece at the feeding and opening device.

Both rollers 1 and 2 are formed as suction rollers. They have perforated cylindrical cover surfaces, inside of which suction inserts 3 and 4 are arranged. The suction inserts 3 and 4 are provided with slit openings 5 and 6 which open closely adjacent the inside surfaces of the covers of the rollers 1 and 2. The suction inserts 3 and 4 are connected at an underpressure (vacuum pressure) source which is depicted on the inside of the suction inserts 3 and 4 with the minus signs extending horizontally through roller centers. The slit opening 5 of the suction insert 3 begins in the yarn formation region 12 and extends opposite the rotational direction of the roller 1 over a predetermined distance in this circumferential direction. The slit opening 6 is arranged offset to the slit opening 5 and is aligned essentially symmetrically to the narrowest position of the wedge slot 11 betwen the two rollers 1 and 2.

In the following description, the term "inwardly rotating roller" means the roller (roller 1 in FIG. 1) which rotates inwardly toward the yarn forming region of the wedge slot and the term "outwardly rotating roller" means the roller (roller 2 in FIG. 1) which rotates outwardly away from the yarn forming region of the wedge slot.

The opening 10 of the fiber feed channel 8 in the plate 7 is located essentially in the shell shaped recess which surrounds the inwardly rotating roller 1. This means that the opening 10 is disposed substantially opposite the cover surface of the roller 1. The straight line extending fiber feed channel 8 is disposed adjacently in the plane of the wedge slot 11 which plane is perpendicular to the common plane of the axles of the rollers 1 and 2. Thus the boundary wall of the fiber feed channel oppositly disposed to the wedge slot 11 extends approximately in the plane of the wedge slot so that the opening 10 is disposed essentially laterally adjacent to the wedge slot 11. The slit opening 5 of the suction insert 3 of the roller 1 inwardly rotatingly extends circumferentially into the region of the opening 10 so that the incoming single fibers become fed to the cover surface of the roller 1 adjacent the yarn forming region 12. A direct feeding of the fibers to the yarn formation region 12 is avoided.

This fiber feeding process is further supported by an auxiliary air stream 14 which streams in via an air channel 13. The slit formed air channel 13 is incorporated in the plate 7 laterally of the fiber feed channel 8 and opens with a slit formed air inlet opening oppositely to the cover surface of the outwardly rotating roller 2. A thin web 15 is left between the fiber feed channel 8 and the air inlet channel 13, which web 15 is disposed approximately in the region of the gusset of the plate 7, which gusset protrudes into the wedge slot 11. The perpendicular distance between the bottom end of the web 15 (as viewed in FIG. 1) and the cover surface of the roller 2 determines the cross section of the air inlet opening for the air stream 14 flowing into the yarn formation region 12 and which is sucked in the slit opening 5 in the suction insert 3. The perpendicular distance between the cover surface of the roller 2 and the web 15 is appropriately in the range between 0.5 and 6 millimeters (mm). The auxiliary air stream 14 flows first approximately tangentially to the cover surface of the roller 2 and finally to the yarn formation region 12. With the assistance of this auxiliary air flow it is achieved that fibers, which are carried by the cover surface which is rotating outwardly from the yarn forming region 12, are removed from this cover surface and return transported to the yarn formation region 12. Because the fibers carried by the cover surface in normal spinning are already very early again loosened and return guided, a uniform fiber assembly results in the yarn formation region 12, which leads to a uniform yarn. The boundary wall 13' of the air inlet channel 13 facing the wedge slot 11 extends parallel to the wedge slot 11 so that the air inlet stream 14 is aligned at the narrowest position between the cover surface of roller 2 and the web 15 to flow approximately tangentially to roller 2. In order not to hinder the air flow directed into the yarn formation region 12 it is important in preferred forms of the embodiment of FIG. 1 to arrange the slit openings 6 spaced from the location of the smallest opening between the web 15 and the cover surface of the roller 2.

As can be seen in FIG. 2, (which for illustrative purposes only shows one roller 1) the extension of the opening 10 of the fiber feed channel 8 is limited in the longitudinal direction of the wedge slot 11 and therewith also in the longitudinal direction of the rollers 1 and 2. The longitudinal extension of the opening 10 in the direction of the wedge slot 11 corresponds in the practice to approximately one-fourth to one half of the length of the effective wedge slot 11. The formed yarn will then be withdrawn in the direction of the wedge slot 11 from the opening 10, meaning toward the left as shown in FIG. 2 of the drawings. As further can be seen from FIG. 2, the fiber feed channel 8 is inclined in the direction of the yarn withdrawal at an angle of approximately 45° in especially preferred practical embodiments. In the there illustrated embodiment (FIG. 2), the feeding of the fibers results with a fiber path component in the yarn withdrawal direction. However the invention also contemplates embodiments wherein the fiber feed channel 8 is so arranged that the feeding results with a fiber path component opposite the yarn withdrawal direction.

The plate or block 7 covers both rollers 1 and 2 over their entire axial length. In the region following the opening 10 of the fiber feed channel 8, only the air inlet openings 13 are provided in plate 7 so that in this region there is air guiding corresponding exclusively to the air stream 14 which flows approximately tangentailly to the cover surface of the outwardly rotating roller 2. Thereby it is assured that the formed yarn in this region is securely held in the plate covered wedge slot 11. As needed, in the region after the opening 10 of the fiber feed channel 8, another distance can be provided between the cover surface of the roller 2 and the web 15 so that a correspondingly controlled air stream is achieved. In contrast to the embodiment of FIG. 2 it is also contemplated to begin the air inlet channel first after the opening 10 of the fiber feed channel 8 so that the therein created air stream 14 has only the problem to hold the formed yarn or occurring yarn securely in the wedge slot 11, respectively the yarn formation region 12.

Figure 3:
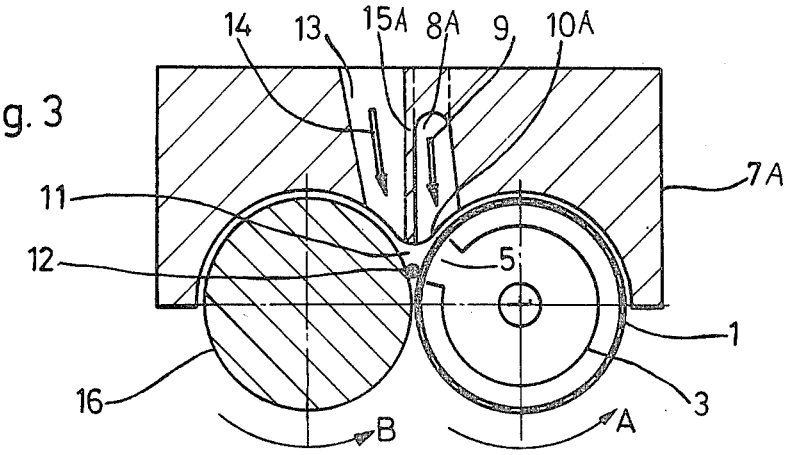
FIG. 3 is a view similar to FIG. 1, showing a second preferred embodiment of the invention.

The embodiment according to FIG. 3 (including like reference numerals with the suffix "A" for corresponding parts described above with respect to FIG. 1) differentiates itself from the embodiment of FIGS. 1 and 2 with respect to the formation of the outwardly rotating roller 16 (direction arrow B), which has a closed cylindrical cover surface. In order to influence the friction effect of the cover surface at the existing or occurring yarn, the cover surface can be provided with a cover which exhibits a higher or a lower friction coefficient than a flat metal surface.

Figure 4:
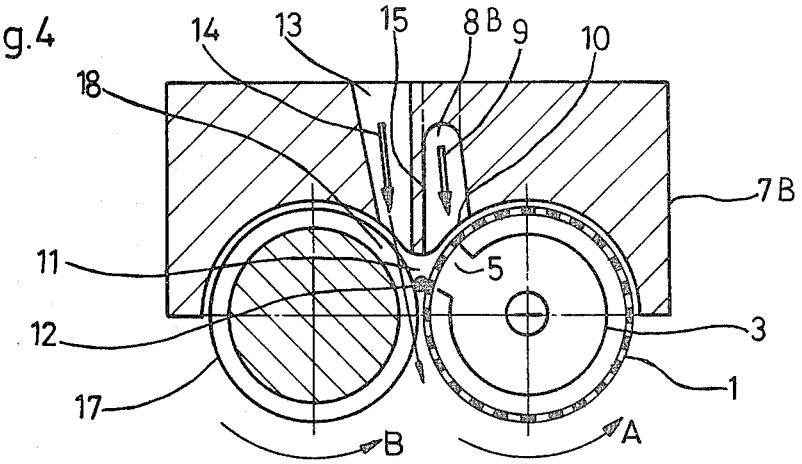
FIG. 4 is a view similar to FIG. 1, showing a third preferred embodiment of the invention.

In the embodiment according to FIG. 4, (including like reference numerals with the suffix "B" for corresponding parts described above with respect to FIG. 1) which otherwise corresponds in its construction to the embodiment of FIGS. 1 and 2, the outwardly rotating roller 17 (arrow B) is provided with a closed cover surface which exhibits ring groove forming profiling 18. The ring groove formed profiling 18 exhibits a small breadth in the axial direction of the roller 17 in the size range of 2 to 6 millimeters (mm). The auxiliary air stream 14 can partially flow over this ring-groove formed profiling 18 at the oppositely disposed side with respect to the fiber feed channel 8B. Thereby it is possible at this side to provide an inwardly protruding suction nozzle in the wedge slot 11 through which nozzle the suction of the air streams 9 and 14 is supported or if needed could also alone be effective. It is then possible to provide the inwardly rotating roller 1 (direction of arrow A), with a closed ring-groove shaped profiling cover surface.

Embodiments similar to those of FIGS. 1 to 4 are also contemplated where the air inlet channel is connected at an air pressure source so that it is possible to control the inlet air stream 14 and its effect independently of the suction of the air stream 9 in the fiber feed channel 8.

Figure 5:
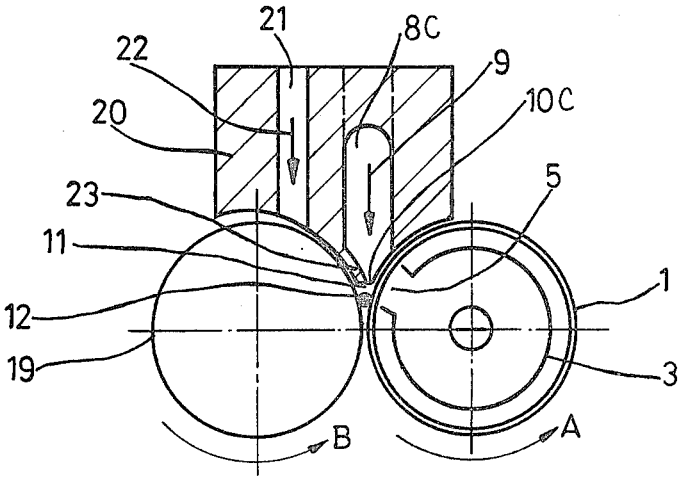
FIG. 5 is a view similar to FIG. 1, showing a fourth preferred embodiment of the invention.

The embodiment of FIG. 5 (including like reference numerals with the suffix "C" for corresponding parts described above with respect to FIG. 1) includes a plate or support block 20 which is provided with an opening 10C of a fiber feed channel 8C oppositely disposed from the cover surface of the inwardly rotating roller (direction of arrow A). The fiber feed channel 8C is in this embodiment arranged essentially in the middle of the wedge slot 11. In the region of the opening 10C the outwardly rotating roller 19 is covered in the region oppositely disposed from the fiber feed channel by means of a web 23, which web 23 extends closely at the yarn formation region 12 and encircles the surface of the roller 19 with a somewhat part cylindrical surface. Through these measures it is achieved that the incoming fibers are not directly fed to the yarn formation region 12, but rather are fed substantially at first onto the cover surface of the roller 1. The inwardly turning roller 1 is provided with a perforated cover surface and an inside suction insert 3, which insert is disposed with a slit opening 5 at the yarn formation region 12 and the mouth 10A of the fiber feed channel.

The plate 20 in the embodiment of FIG. 5 extends transversely to the rollers 1 and 19 and is dimensioned to be relatively small, this means that plate 20 covers only approximately one fourth of the cover surface of the roller 1 and approximately one third of the cover surface of the roller 19. In the portion of the cover surface of the roller 19 covered by the plate 20 there is provided a slot shaped inlet channel 21 for the inlet of pressure air through which an inlet air stream 22 is guided to the roller 19. The slot formed opening of the inlet channel 21 is disposed at a relatively large distance from the wedge slot 11; preferably approximately one fourth of the circumference of the roller 19 as shown in FIG. 5. Between the mouth 21 of the inlet channel 21 and the mouth or opening 10 of the fiber feed channel 8 there is provided a conforming guide surface in the plate 20 adjacent the contour of the roller 19. This guide surface is so formed in especially practical embodiments that it forms a nozzle narrowing in cross section from the mouth of the inlet channel 21 up to the yarn formation region 12. Through the inlet stream 22, the pressure of which is advantageously adjustable, there is achieved an air flow in the region between the mouth or opening 10 of the fiber feed channel 8 and the yarn formation region 12, which air flow is first onto the cover surface of the roller 19 and then to the cover surface of the roller 1. Thereby it is supported that the incoming fibers are supplied to the cover surface of the inwardly rotating roller 1. Furthermore it is achieved that the fibers which eventually remain hanging at the cover surface of the roller 19 are loosened and return guided into the yarn formation region 12.

In the embodiment of FIG. 5 the outwardly turning roller 19 (direction of arrow B) is advantageously provided with a closed cover surface which exhibits a smooth cylindrical shape. Other embodiments are contemplated where the roller is provided with ring shaped groove profiling corresponding to roller 17 of FIG. 4.

Figure 6:
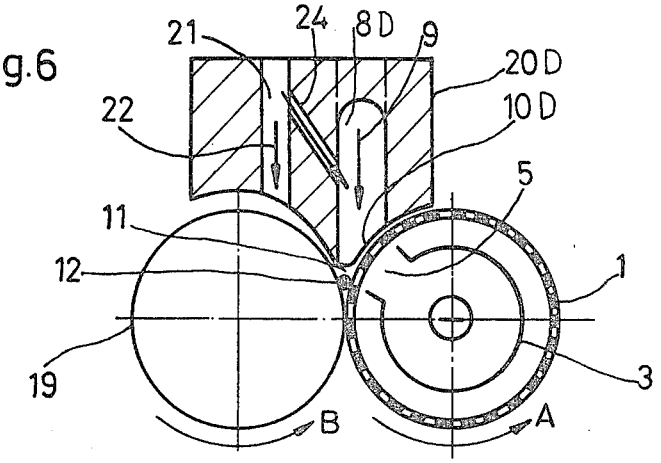
FIG. 6 is a view similar to FIG. 1, showing a fifth preferred embodiment of the invention.

In order to also support the air stream 9 in the fiber feed channel 8D by means of the air pressure source connected to the inlet channel 21, which effects the transport of the fibers, the embodiment of FIG. 6 (including like reference numerals with the suffix "D" for corresponding parts described above with respect to FIG. 1) is provided in the region of the inlet channel 8D with a slot-shaped opening 24 between the inlet channel 21 and the fiber feed channel 8D which is inclined in the stream direction of the air stream 9 and the consequent fiber transport direction. As a result of the injector principle this auxiliary air stream promotes the generation of the air stream 9 in the fiber feed channel.

Embodiments are also contemplated which are similar to those of FIG. 5 and 6 but with the outwardly turning roller formed as a suction roller which is provided with a suction insert which is connected with a slot opening at the region of the smallest position of the wedge slot 11. In this case in order to prevent the outflow of the pressurized air through the cover surface of the thus modified roller 19, a suction insert corresponding to the suction insert 26 of FIG. 7 is provided which has an outer surface disposed oppositely of the inner surface of the cover of the modified roller 19 with a small distance.

Figure 7:
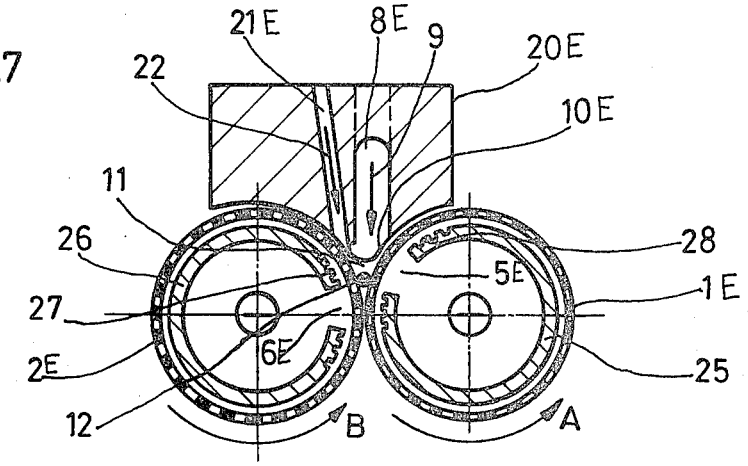
FIG. 7 is a view similar to FIG. 1, showing a sixth preferred embodiment of the invention.

In the embodiment of FIG. 7 (including like reference numerals with the suffix "E" for corresponding parts described above with respect to FIG. 1) the inwardly turning roller 1E (direction of arrow A) and also the outwardly running roller 2E (direction of arrow B) are formed as suction rollers. These rollers 1E and 2E are formed as shells with perforated cover surfaces in which inner suction inserts 25 and 26 are arranged and which inserts exhibit a cylindrical outer contour and are disposed at a small distance from the inner surfaces of the shells of the rollers 1E and 2E. The suction insert 25 is provided with a slot opening 5E which extends from the yarn formation region 12 in the circumferential direction against the rotational drrection of the roller 1E up to the region of the mouth 10E of the fiber feed channel 8E. Suction insert 26 is provided with a slot opening 6E which is aligned essentially at the smallest or narrowest region of the wedge slot 11 between the two rollers 1E and 2E.

The suction inserts 25 and 26 are provided at their outer surfaces disposed oppositely of the shells of the rollers 1E and 2E at least in the region of the slot openings 5E and 6E with rib shaped profiling 27 and 28 which form a kind of labyrinth seal.

In the embodiments of FIG. 7 the fiber feed channel 8E in the plate 20E is arranged essentially in the middle of the wedge slot 11 so that the mouth or opening 10E is disposed in the region of the inwardly protruding gusset of the plate 20E into the wedge slot 11. In order to also achieve in this embodiment that the incoming fibers are fed essentially to the cover surface of the inwardly turning roller 1E, an inlet channel 21E is provided in the plate 20E. Inlet channel 20E is connected at a pressure air source and is disposed closely adjacent the mouth 10E and opens oppositely of the cover surface of the outwardly turning roller 2E. Further, the inlet channel 21E is lightly inclined with respect to the plane of the wedge slot 11 (vertical middle plane between rollers 1E and 2E as seen in FIG. 7) so that the auxiliary air stream 22 is directed approximately tangentially to the cover surface of the roller 2E. With this auxiliary air stream 22 it is furthermore achieved that fibers that become hung up at the mantle or cover surface of the roller 2E are loosened and return transported into the yarn formation region 12.

Figure 8:
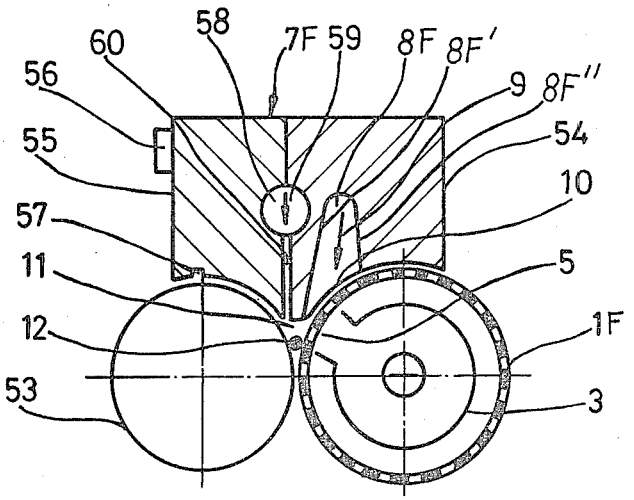
FIG. 8 is a view similar to FIG. 1, showing a seventh preferred embodiment of the invention.

In the embodiment of FIG. 8 (including like reference numerals with the suffix "F" for corresponding parts described above with respect to FIG. 1) the rollers 1F and 53 are provided with different diameters whereby the diameter of the roller 53 is smaller, which rollers together form a wedge slot 11 and a yarn formation region 12. The roller 53 can be driven at the same rotational speed as roller 1F so that its cover surface travels at a smaller circumferential velocity corresponding to the diameter difference. The inwardly turning roller 1F is formed as a suction roller, this means it possesses a perforated cover surface and a suction insert 3 at the inside which is provided with a slot opening 5F. The slot opening 5F extends from the yarn formation region 12 in the circumferential direction of the roller 1F against its rotational direction up to the region of the mouth or opening 10F of the fiber feed channel 8F. The fiber feed channel 8F which is worked or formed into the plate 7F, is offset to the wedge slot 11 and disposed oppositely of the roller 1F. The boundary wall 8F' at the side of the wedge slot 11 is disposed at the yarn formation region while the oppositely disposed boundary wall 8F'' extends approximately radially to the roller 1F. The incoming fibers are also in this embodiment fed essentially to the cover surface of the roller 1F and later reach the yarn formation region 12 carried on the cover surface. This effect is supported by means of an air inlet flow or stream 59 which is disposed at a small distance adjacent the wedge slot 11 approximately tangentially to the cover surface of the outwardly turning roller 53. This inlet stream 59 is created by a pressure air source and guided by means of slot formed inlet channel 60 to adjacent the cover surface of the roller 53.

The plate 7F consists of two parts 54 and 55 which have a separating plane in the region of the inlet channel 60. In the region of this separating plane, parts 54 and 55 have half cylindrical recesses extending parallel to the axes of the rollers 1F and 53 which together form a cylindrical air pressure channel 58. Furthermore, there are openings or receptacles in one or both of the parts 54 and 55 at the separating plane which form the slot formed inlet opening 60.

The parts 54 and 55 of the plate 7F are so dimensioned that they respectively seal off approximately one third of the cover surfaces of the rollers 1F and 53. In order to prevent an undesired outflowing of the inguided pressure air in the rotational direction of the outwardly turnig roller 53 there is a groove 57 formed in the part 55 disposed oppositely of the roller 53, which groove forms a kind of labyrinth seal. It should be understood there can also be several of such grooves provided according to the invention. The one small diameter roller 53 can be formed as a suction roller or also as a roller with a closed and in any event profiled cover surface according to other preferred embodiments. These other non-illustrated embodiments also exhibit the desired effects regarding the supply of an auxiliary air flow to assist in controlling the fibers in the region of the friction rollers.

Figure 9:
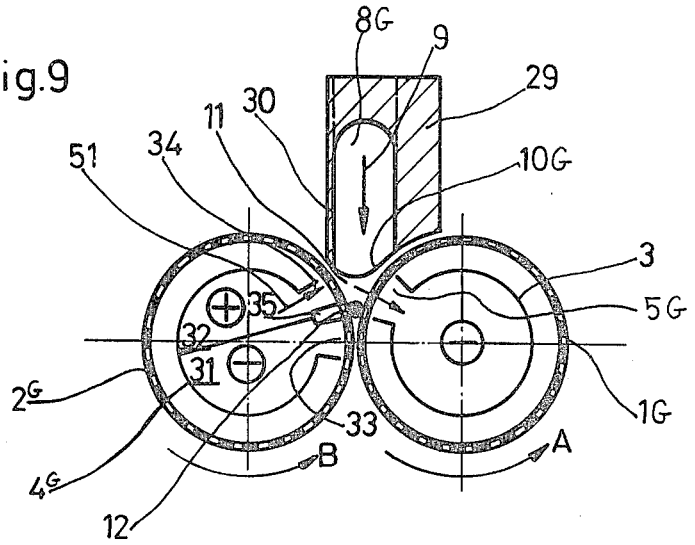
FIG. 9 is a view similar to FIG. 1, showing an eighth preferred embodiment of the invention.
Figure 10:
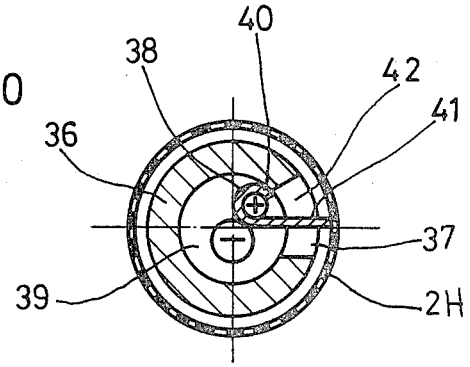
FIG. 10 is a cross-sectional schematic view of a further embodiment of a friction roller constructed in accordance with the present invention for use with the embodiment of FIG. 9.
Figure 11:
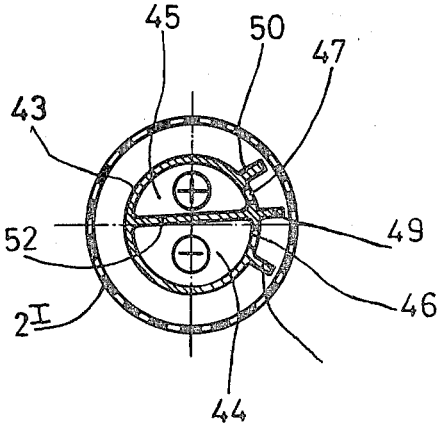
FIG. 11 is a cross-sectional schematic view of a still further embodiment of a friction roller constructed in accordance with the present invention for use with the embodiment of FIG. 9.

The embodiments according to FIGS. 9 to 11 differ from the above-mentioned embodiments in principle in that the desired auxiliary air stream is not achieved from an air pressure source acting from outside the outwardly turning friction rollers, but rather through an air stream coming from inside such rollers.

In the embodiment of FIG. 9 (including like reference numerals with the suffix "G" for corresponding parts described above with respect to FIG. 1) two rollers 1G and 2G are provided which are disposed to extend parallel and closely adjacent one another and to be driven in the same sense in the direction of the arrows A and B. Fibers are guided to the wedge slot 11 formed by the two rollers 1G and 2G and are twisted together in the yarn formation region 12 to form a yarn that is drawn off in the longitudinal direction of the wedge slot 11. The inwardly rotating roller 1G is formed as a suction roller. Roller 1G has a perforated cover surface and a suction insert 3 arranged at the inside thereof, which insert 3 is provided with a slot opening 5G extending from the yarn formation region 12 in the circumferential direction of the roller 1 opposite the rotational direction to the region of the mouth 10G of the fiber feed channel 8G.

The fiber feed channel 8G is aligned approximately in the middle of the plane of the wedge slot 11. The channel 8G is disposed in a construction part 29 which has a widened wall part disposed oppositely of the inwardly rotating roller 1 and which exhibits a concave sealing surface opposite the cover surface of the roller 1G. The outwardly rotating roller 2 has a perforated cover surface. In the inside of this roller 2G there is arranged a suction insert 4G which is disposed with a slot opening 33 at the region of the narrowest position of the wedge slot 11 between the two rollers 1G and 2G.

The suction insert 4G is divided by means of a separating wall 35 into a vacuum or underpressure chamber 31 connected at an underpressure source and an overpressure chamber 32 connected at an overpressure source. The overpressure chamber 32 is provided with a slot opening 34 which is arranged at the circumferential region of the roller 2G immediately adjacent the yarn formation region 12. The separating wall 35 which extends closely to the inner surface of the roller 2G divides the two slot openings 33 and 34.

The opening 10G of the fiber feed channel 8G which is bordered in the region of the roller 2G by a wall 30, extends to the region of the slot opening 34 of the over pressure chamber 32. The wall 30 is extended to a position closely adjacent to the cover surface of the roller 2G and is preferably disposed for this purpose at a distance of approximately in the range of 0.5 to 2 millimeters from the surface of roller 2G. Through the airstream 51 flowing out of the slot opening 34 and eventually into the slot opening 5G of the suction insert 3G of the roller 1G, the incoming fibers being fed to the cover surface of the roller 1G are in large part turned before they reach the yarn formation region 12. Furthermore, the airstream 51 effects that the fibers eventually hanging on at the cover surface of the outwardly rotating roller 2G, thus fibers moving outwardly from the yarn formation region 12, are loosened from the cover surface and return guided to the yarn formation region 12. The effect of the air stream 51 is controlled through the selected overpressure and/or the width of the slot opening 34.

The slot opening 34 of the air pressure insert forming over pressure chamber 32, extends in the axial direction of the roller 2G over the axial length of the mouth or opening 10G of the fiber inlet channel 8G. It can however also be provided according to other preferred embodiments that the slot opening 34 extends over the entire length of the roller 2G with a respective differentiating cross section along the length thereof, so that it effects the region following the opening 10G and prevents the forming yarn from being taken along out of the yarn formation region 12 with the outwardly rotating roller 2G. It can be provided that both rollers 1G and 2G are fully freely disposed in areas downstream (fiber yarn direction) of the mouth 10G of the fiber feed channel 8G. Embodiments are also contemplated where the friction rollers are covered in the axial direction of the rollers 1G and 2G by an extension of the construction parts carrying the fiber feed channel. Embodiments are also contemplated where the underpressure chamber 31 is limited only to the region of the mouth 10 of the fiber feed channel 8G. Embodiments are also contemplated where the underpressure chamber 31 is dispensed with entirely.

In FIG. 10 a roller 2H is illustrated which can be substituted for the outwardly rotating roller 2G of the embodiment of FIG. 9. The roller 2H according to FIG. 10 is also formed as a suction roller. The roller 2H includes for this purpose a suction insert 36 formed with a cylindrical profile and which has an outer surface spaced a small distance from the inner surface of the perforated cover surface of the roller 2H. The suction insert 36 includes an underpressure chamber 39 which opens by means of a slit opening 37 to the region of the narrowest position of the wedge slot 11 corresponding to the embodiment of FIG. 9. The slot opening 37 is bordered by means of a web 41 of a pressure air insert 38. The pressure air insert 38, which can essentially be formed out of pipe with an overpressure channel 40, is inserted inside of the suction insert. Overpressure channel 40 opens by means of a slot opening 42 to the circumferential region of the roller 2H adjacent the yarn formation region 12 (FIG. 9).

The roller 2I of FIG. 11 can be substituted for the outwardly rotating roller 2G of the embodiment of FIG. 9. Inside of the perforated cover surface of the roller 2G there is arranged a hollow profile 43 which forms a suction insert 44 and a pressure air insert 45 separated by means of a separating wall 52. The suction insert 44 opens with a slot opening 46 and the pressure insert 45 opens with a slot opening 47, respectively to the above described regions of the roller 2I (compare FIG. 9). The slot openings 46 and 47 are bordered with respect to one another by an intermediate web 49 and by means of webs 48 and 50 with respect to the remaining regions in their effects. The hollow profile 43 is practically manufactured as an extruded or press extruded profile, which can be inexpensively and simply manufactured in the desired indicated form.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for open end friction spinning comprising:

two friction rollers arranged adjacent one another to form a yarn forming wedge slot therebetween, said friction rollers being rotatably driven in the same rotation with one inwardly rotating roller having its cover surface rotating inwardly toward the wedge slot and the other outwardly rotating roller having its cover surface rotating outwardly from the wedge slot, fiber feed channel means for guiding fibers to the region of the rollers, said fiber feed channel means including a fiber feed inlet opening in the region of one of the wedge slot and the outer surface of the inwardly rotating roller, transport air stream inducing means for inducing a flow of transport air to aid in the transport of the fibers in the feed channel means, and auxiliary air stream inducing means for inducing an auxiliary air flow adjacent the outer surface of the outwardly rotating roller opposite the rotational direction of the outwardly rotating roller toward the wedge slot, whereby undesired transport of fibers away from the wedge slot by the outwardly rotating roller is minimized to improve yarn uniformity and quality.

2. Apparatus according to claim 1, wherein said auxiliary air stream inducing means includes an auxiliary air inlet opening toward the cover surface of the outwardly rotating roller.

3. Apparatus according to claim 2 wherein yarn withdrawal means are provided for withdrawing yarn from the wedge slot in a yarn withdrawal direction, and wherein the fiber feed inlet opening is inclined toward the withdrawal direction of the yarn formed in the wedge slot.

4. Apparatus according to claim 2, wherein support plate means are provided for covering at least a portion of the circumference of the rollers, said support plate means including recesses conforming to the outer circumference of the rollers, wherein said fiber feed inlet opening is disposed in the support plate means, and wherein said auxiliary inlet opening exhibits a slit shaped form and is arranged at the support plate means adjacent the fiber feed inlet opening.

5. Apparatus according to claim 4, wherein boundary wall means of the air channel leading to the auxiliary inlet opening extend at least approximately tangentially to the circumference of the covered surface of the outwardly turning roller.

6. Apparatus according to claim 4, wherein the fiber feed inlet opening is disposed so that the transport direction of incoming fibers is offset from the middle vertical plane of the wedge slot in the direction toward the inwardly rotating roller cover surface, said fiber feed inlet opening being disposed laterally adjacent the yarn formation region of the wedge slot.

7. Apparatus according to claim 5, wherein the fiber feed inlet opening is disposed so that the transport direction of incoming fibers is offset from the middle vertical plane of the wedge slot in the direction toward the inwardly rotating roller cover surface, said fiber feed inlet opening being disposed laterally adjacent the yarn formation region of the wedge slot.

8. Apparatus according to claim 2, wherein said fiber feed channel means is bounded in the region of the fiber feed inlet opening by first and second feed channel boundary wall means which generally face one another, said first feed channel boundary wall means being disposed closer to the middle of the wedge slot than the second boundary wall means.

9. Apparatus according to claim 4, wherein said fiber feed channel means is bounded in the region of the fiber feed inlet opening by first and second feed channel boundary wall means which generally face one another, said first feed channel boundary wall means being disposed closer to the middle of the wedge slot than the second boundary wall means.

10. Apparatus according to claim 9, whrein said first feed channel boundary wall means extends perpendicularly to the common plane containing the axes of the two rollers.

11. Apparatus according to claim 9, wherein said first feed channel means extends in a direction at least approximately toward the middle of the wedge slot.

12. Apparatus according to claim 10, wherein said first feed channel means extends in a direction at least approximately toward the middle of the wedge slot.

13. Apparatus according to claim 8, wherein said first and second feed channel boundary wall means extend parallel to one another.

14. Apparatus according to claim 8, wherein the second feed channel boundary wall means extends in a direction at least approximately radially to the inwardly rotating roller.

15. Apparatus according to claim 9, wherein the second feed channel boundary wall means extends in a direction at least approximately radially to the inwardly rotating roller.

16. Apparatus according to claim 4, wherein an auxiliary air inlet channel means leads to the auxiliary inlet opening, and wherein pressurizing means are provided for communicating pressurized air to the air inlet channel means.

17. Apparatus according to claim 16, wherein the auxiliary inlet opening is disposed at the outer surface of the outwardly rotating roller at a distance spaced from the wedge slot, and wherein a shell-like covering guide surface is provided in the support plate means for guiding the flow of auxiliary air from the auxiliary inlet opening to the wedge slot between the covering guide surface and the outer surface of the outwardly rotating roller.

18. Apparatus according to claim 16, wherein at least one auxiliary bypass connection is provided between the auxiliary air inlet channel means and the fiber feed channel means for supplying auxiliary air flow in the fiber transport direction to the fiber feed channel means.

19. Apparatus according to claim 16, wherein said support plate means is formed of two support plate parts connected along a separating line extending approximately in the longitudinal direction of the wedge slot, wherein the air inlet channel means is formed at least in part by recesses machined or formed in at least one of the two support plate parts, which recesses are closed to form the air inlet channel means by the connection of the two support plate parts together.

20. Apparatus according to claim 19, wherein said recesses form a pressure channel and at last one slot shaped auxiliary air inlet opening.

21. Apparatus according to claim 4, wherein at least the inwardly rotating roller is constructed as a suction roller with a perforated cover surface and wherein a suction insert is disposed inside of the cover surface and has a slot shaped suction opening facing toward the yarn formation region of the wedge slot.

22. Apparatus according to claim 21, wherein the slot shaped suction opening extends in the circumferential direction of the inwardly rotating roller up to the region where the fiber feed inlet opening is disposed oppositely facing said inwardly rotating roller.

23. Apparatus according to claim 4, wherein the outwardly rotating roller is constructed as a suction roller with a perforated cover surface, and wherein a suction insert is disposed inside of the cover surface and has a slot shaped opening facing the region of the narrowest section of the wedge slot.

24. Apparatus according to claim 21, wherein the outwardly rotating roller is constructed as a suction roller with a perforated cover surface, and wherein a suction insert is disposed inside of the cover surface and has a slot shaped opening facing the region of the narrowest section of the wedge slot.

25. Apparatus according to claim 4, wherein the outwardly rotating roller exhibits a closed cylindrical cover surface.

26. Apparatus according to claim 25, wherein the cylindrical cover surface of the outwardly rotating roller exhibits ring grooved profiling for accomodating air flow thereby.

27. Apparatus according to claim 1, wherein the outwardly rotating roller has a perforated cover surface and an air pressure insert disposed on the inside of the roller, and wherein the air pressure insert has a slot opening to the region between the fiber feed inlet opening and the yarn forming region of the wedge slot.

28. Apparatus according to claim 27, wherin the outwardly rotating roller further includes a suction insert on the inside of the roller, and wherein the suction insert has a slot aligned with the narrowest region of the wedge slot.

29. Apparatus according to claim 28, wherein a common hollow profile is provided for forming the suction insert and the air pressure insert, said profile including a common wall separating the inserts.

30. Apparatus according to claim 2, wherein the auxiliary inlet opening extends along a cover line over the entire length of the outwardly rotating roller.

31. Apparatus according to claim 4, wherein the auxiliary inlet opening extends along a cover line over the entire length of the outwardly rotating roller.

32. Apparatus according to claim 30, wherein the cross section of the auxiliary inlet opening varies along its length.

33. Apparatus according to claim 2, wherein the auxiliary inlet opening extends, as viewed in the yarn withdrawal direction, from a beginning position after the fiber feed inlet opening to over the connecting part of the cover surface of the outwardly rotating rollers.

* * * * *